US009529294B2

(12) United States Patent
Heilman et al.

(10) Patent No.: US 9,529,294 B2
(45) Date of Patent: Dec. 27, 2016

(54) COLORLESS ULTRAVIOLET SECURITY TONER

(71) Applicant: Troy Group, Inc., Costa Mesa, CA (US)

(72) Inventors: Kevin L. Heilman, Wheeling, WV (US); Michael R. Riley, Steubenville, OH (US)

(73) Assignee: TROY GROUP, INC., Costa Mesa, CA (US)

( * ) Notice: Subject to any disclaimer, the term of this patent is extended or adjusted under 35 U.S.C. 154(b) by 0 days.

(21) Appl. No.: 14/857,389

(22) Filed: Sep. 17, 2015

(65) Prior Publication Data

US 2016/0091814 A1 Mar. 31, 2016

Related U.S. Application Data

(60) Provisional application No. 62/057,093, filed on Sep. 29, 2014.

(51) Int. Cl.
*G03G 9/08* (2006.01)
*G03G 9/09* (2006.01)

(52) U.S. Cl.
CPC ..... *G03G 9/0926* (2013.01); *G03G 9/081* (2013.01); *G03G 9/0817* (2013.01); *G03G 9/0819* (2013.01)

(58) Field of Classification Search
CPC ..... G03G 9/081; G03G 9/0819; G03G 9/0926
USPC ..... 430/137.18, 107.1
See application file for complete search history.

(56) References Cited

U.S. PATENT DOCUMENTS

| | | | |
|---|---|---|---|
| 8,735,038 | B2 | 5/2014 | Kunii et al. |
| 2006/0063085 | A1 | 3/2006 | Lee et al. |
| 2010/0086867 | A1 | 4/2010 | Iftime et al. |

OTHER PUBLICATIONS

International Search Report and the Written Opinion of the International Searching Authority, PCT/US2015/051330, U.S. Search Authority, date of mailing, Dec. 18, 2015, 8 pages.

*Primary Examiner* — Mark A Chapman

(57) ABSTRACT

In accordance with various embodiments of the invention, a method of forming an ultraviolet security toner for use in printing hardware originally designed to use chemically prepared toner includes melt-blending binder resin particles and optionally a charge-control agent, a colorant and a releasing agent. The fluorescent pigment is then admixed to the melt-blended particles to form a fluorescent pre-toner. A first inorganic material is then blended with the fluorescent pre-toner, coating the particles of the fluorescent pre-toner with the first inorganic material. A second inorganic material is then blended with the coated pre-toner, adding another layer of coating to the fluorescent pre-toner. The first inorganic material has an average particle diameter size that is less than the average particle diameter size of the fluorescent pigment particles and the second inorganic material has an average particle diameter size less than that of the first inorganic material.

20 Claims, 4 Drawing Sheets

COLORLESS ULTRAVIOLET SECURITY TONER

CROSS REFERENCE TO RELATED APPLICATIONS

This application claims the benefit of U.S. provisional patent application Ser. No. 62/057,093 filed on Sep. 29, 2014 and titled "Novel Ultra Violet Security Toner that is Colorless" which is incorporated in this application as if fully set forth herein.

BACKGROUND OF THE INVENTION

1. Field of the Invention

The present invention generally relates to toners used for document imaging and methods for making the toners. More particularly, the invention relates to an ultraviolet security toner that can be used in printers designed to use chemically prepared toner and that fluoresces when subjected to ultraviolet or near ultraviolet light.

2. Description of Related Art

Toner-based document imaging, such as electrophotographic, iongraphic, magnetographic, and similar imaging techniques, generally involves forming an electrostatic or magnetic image on a charged or magnetized photoconductive plate or drum, brushing the plate or drum with charged or magnetized toner, transferring the image onto a substrate such as paper, polyester film, or the like, and fusing the toner onto the substrate using heat, pressure, and/or a solvent. Using this technique, relatively inexpensive images can be formed relatively easily and quickly on a surface of the substrate.

Recently, toners have been developed for use in document security, such as ultraviolet security toners. Images formed by an ultraviolet toner may appear colorless when viewed under normal lighting but will fluoresce when subjected to an ultraviolet light. The ultraviolet images can provide document security in a variety of ways. As an example, a company may print checks including the payment amount using both traditional toner (such as black toner) and ultraviolet security toner. Upon receipt, a bank teller may view the check under an ultraviolet light in order to compare the printed payment amount in traditional toner to the printed payment amount in ultraviolet security toner. If the printed values differ, the teller will know that the check has been altered and should not be accepted.

Toners, including ultraviolet toners, may be formed conventionally or chemically. Conventional toners are typically manufactured using size reduction methods in which materials are melt mixed and systematically reduced in size to form the toner. As shown in FIG. 1, an X times magnified image of a conventional toner 100 formed by size reduction, particles 102 having uneven sides and edges that define craters.

Recently, companies have been developing chemically prepared toner (CPT) as an alternative to preparing toners for size reduction. CPT toners are manufactured using synthesis techniques in which the toner particles are developed and grown into the desired particle size and shape. As shown in FIG. 2, an X times magnified image of a CPT toner 200, particles 202 of the CPT toner 200 are generally spherical in shape.

With reference to FIGS. 1 and 2, the uneven edges and sides of the particles 102 of the conventional toner 100 cause reduced flowability, as compared to the spherical particles 202 of the CPT toner 200. The charge distribution of the CPT toner 200 is typically more uniform than the charge distribution of the conventional toner 100 as a result. Printers are typically designed to use only either conventional toners or CPT toners. The two are not compatible due at least in part to the difference in flow characteristics and charge distribution. The improved flow and charge distribution of a CPT toner allows the CPT toner to be used in printers used for printing higher quality images.

The process of conventional toner manufacturing is well documented and has been used in the art for decades. Equipment used to manufacture conventional toner is readily available and has a much lower initial cost than equipment for manufacturing CPT toner. Both types of toners provide advantages: conventional toner provides the advantage of being relatively inexpensive while CPT toner provides the advantage of producing a higher print quality.

For the foregoing reasons, improved conventional ultraviolet toners that are relatively inexpensive to make and provide improved print quality are needed.

SUMMARY OF THE INVENTION

The present invention provides a toner for producing ultraviolet images that generates improved print quality while being less expensive to produce. In particular, the toner can be used in printing hardware originally designed to use chemically prepared toner. In addition to addressing the various drawbacks of the known toners and the methods of manufacture the invention provides a toner that fluoresces when exposed to ultraviolet light and which is relatively easy and inexpensive to manufacture. The toner described herein can be used for secure printing and copying applications, as well as for printing or copying on-demand documents, signs, and the like, which may be used for business, comfort, safety, or amusement.

According to the invention, methods of making the improved ultraviolet security toner includes melt-blending binder resin particles and optionally a charge-control agent, a colorant and a releasing agent. The fluorescent pigment is then admixed to the melt-blended particles to form a fluorescent pre-toner. A first inorganic material is then blended with the fluorescent pre-toner, coating the particles of the fluorescent pre-toner with the first inorganic material. A second inorganic material is then blended with the coated fluorescent pre-toner, adding another layer of coating to the fluorescent pre-toner. The first inorganic material has an average particle diameter size that is less than the average particle diameter size of the fluorescent pre-toner and the second inorganic material has an average particle diameter size less than that of the first inorganic material.

According to the invention, the ultraviolet security toner includes binder resin particles and fluorescent pigment particles. The ultraviolet security toner optionally includes a charge-control agent, a colorant and a releasing agent. The ultraviolet security toner further includes a first inorganic material and a second inorganic material. The first inorganic material has an average particle diameter size that is less than the average particle diameter size of the fluorescent pigment particles and the second inorganic material has an average particle diameter size less than that of the first inorganic material.

According to the invention, the novel ultraviolet security toner may be prepared using the following method. Initially, binder resin particles and optionally a charge-control agent, a colorant and a releasing agent are melt-blended. A fluorescent pigment is then admixed to the melt-blended particles to form a fluorescent pre-toner. First silica particles (inorganic material) are then blended with the fluorescent pre-toner to coat the particles. The coated pre-toner is then blended with second silica particles (inorganic material) to add another coating. The first inorganic material has an average particle diameter size that is less than the average particle diameter size of the fluorescent pre-toner and the second inorganic material has an average particle diameter size less than that of the first inorganic material.

BRIEF DESCRIPTION OF THE DRAWINGS

A more complete understanding of the present invention may be derived by referring to the detailed description and claims, considered in connection with the drawing figures described below:

DETAILED DESCRIPTION OF THE PREFERRED EMBODIMENTS

The present invention provides a relatively inexpensive ultraviolet security toner that can be used with high definition printers designed to use chemically prepared toner (CPT). The addition of inorganic materials to conventional toner particles results in a toner having improved flow characteristics and better charge distribution than conventional toners, to the extent that the toner can be used with printers designed to use CPT toner.

Figure 1:
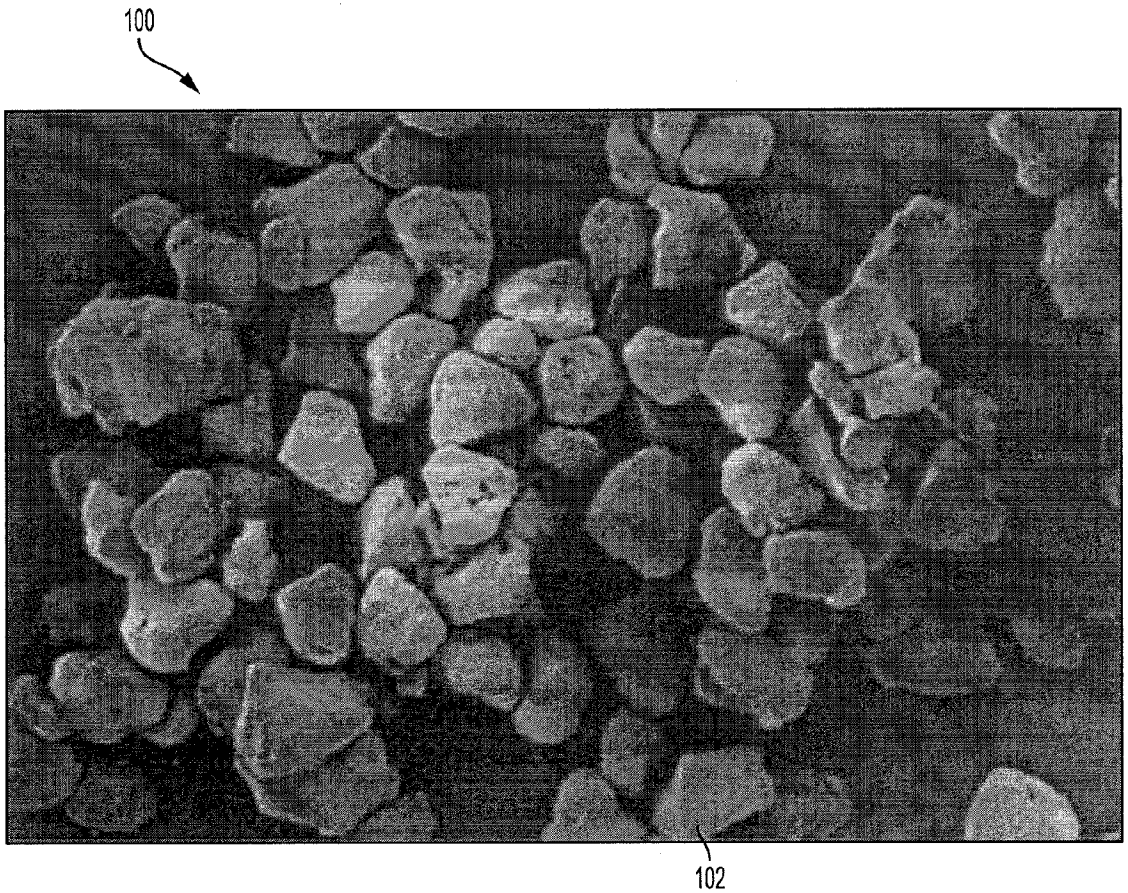
FIG. 1 PRIOR ART
FIG. 1 is a magnified illustration of the particles of a conventional toner.
Figure 2:
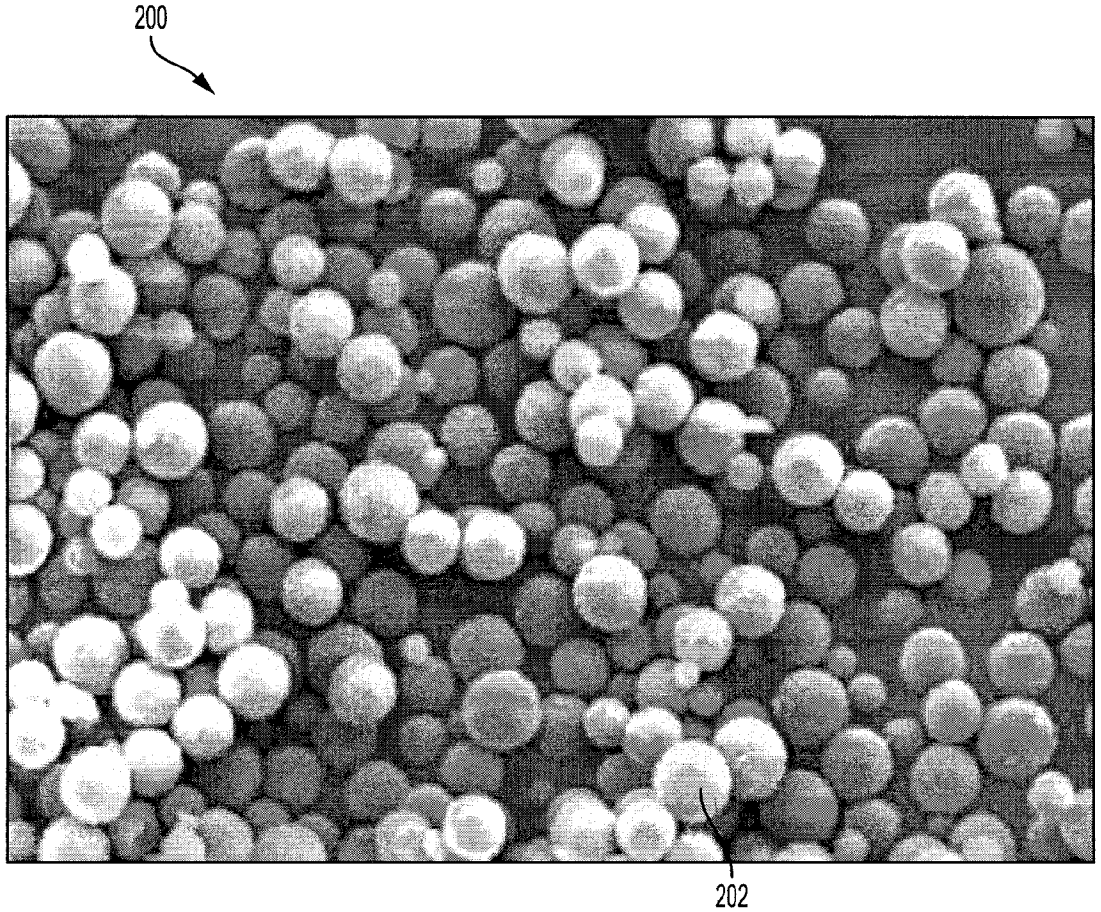
FIG. 2 PRIOR ART
FIG. 2 is a magnified illustration of the particles of a chemically prepared toner.
Figure 3:
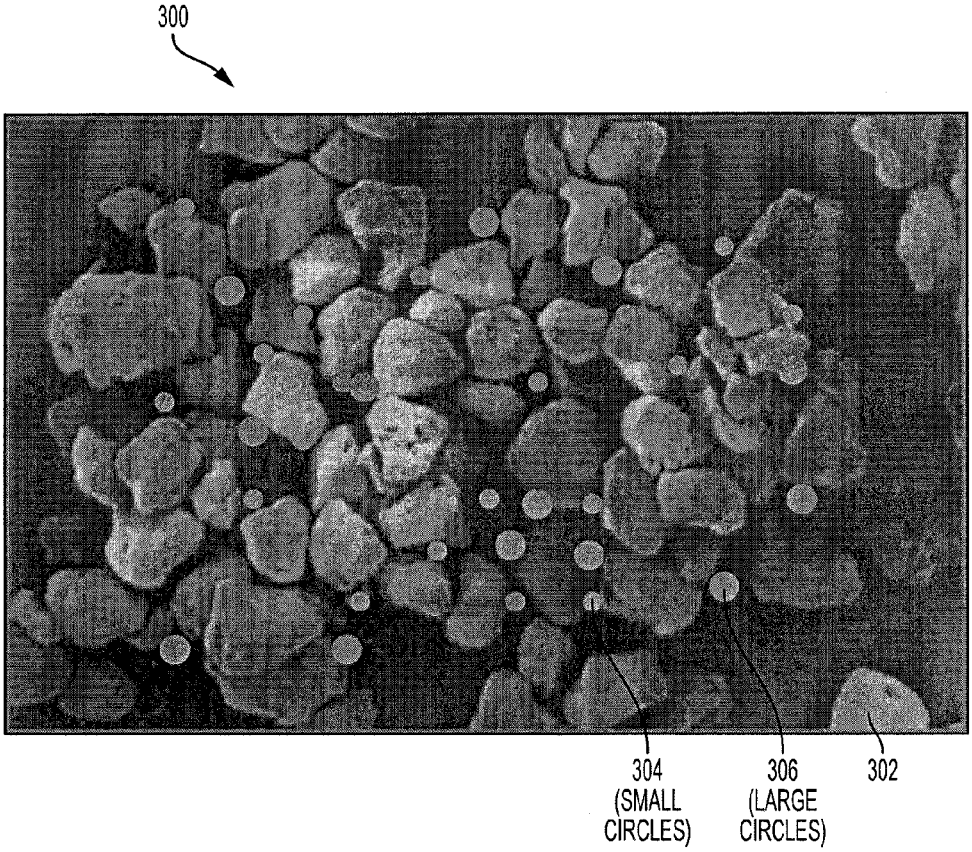
FIG. 3 is a magnified illustration of particles of an ultraviolet security toner made according to size reduction techniques and the method of the present inventions over conventional toner, according to an embodiment of the present invention.

FIG. 3 illustrates an ultraviolet security toner 300 that includes size-reduced particles 302, particles of a first inorganic material 304 and particles of a second inorganic material 306. The size-reduced particles 302 normally include a thermoplastic binder resin and a fluorescent pigment and optionally one or more of a charge-control agent, a colorant or a releasing agent. The size-reduced particles 302 make up a conventional toner. Addition of the first inorganic material 304 and the second inorganic material 306 improves flowability and charge distribution of the toner 300, as well as providing additional benefits which will be described below. The toner 300 can be used in place of CPT toners and provides higher quality images than can be obtained by conventional toners.

The thermoplastic binder resin helps fuse the toner 300 to a substrate. Exemplary materials suitable for the thermoplastic binder resin include one or more of the following: polyester resins, styrene copolymers and/or homopolymers (e.g., styrene acrylates, methacrylates, styrene-butadiene—epoxy resins, latex-based resins, bio-based polymer resins or any hydrocarbon resin used to manufacture electrostatic toner). By way of example, the thermoplastic binder resin may include a polyester binder resin available under as XPE-1976 from Image Polymers of Andover, Mass. In some embodiments, the thermoplastic binder resin may be present between 20 parts per weight and 95 parts per weight. By way of example, the thermoplastic binder resin may be present at about 88 parts per weight. (When the term "about" is used herein, it refers to the value+/−10% of the value.)

The fluorescent pigment can include any fluorescent pigments. In some embodiments, the fluorescent pigment may be considered an invisible fluorescent pigment. However, the fluorescent pigment may also or instead include a daylight fluorescent pigment. In that regard, the fluorescent pigment may be colorless when viewed under most normal lighting (sunlight, incandescent light, fluorescent light, halogen light or the like) and may fluoresce when viewed under ultraviolet (UV) light or near-UV light. In that regard, the toner 300 may be relatively invisible and/or may appear as a glossy surface on a white or off-white substrate. The toner 300 may appear white when printed on a colored substrate or may appear lighter than the color of the colored substrate. By way of example, the fluorescent pigment can include a thermoset fluorescent pigment available under the tradename Radglo™ P-09 UV Blue of DayGlo Color Corporation of Cleveland, Ohio. In some embodiments, the fluorescent pigment may be present between 1 part per weight and 20 parts per weight. By way of particular example, the fluorescent pigment may be present at about 5 parts per weight.

The toner 300 may include a colorant. The colorant may be any colorant that can be used in a toner. When no colorant is included, the toner 300 will be colorless as described above. When the colorant is included, the toner 300 will have color similar to the color of the colorant. When included in the toner, the colorant can be any colorant of any suitable color used for electrophotographic image processing, such as one or more of: iron oxide, other magnetite materials, carbon black, manganese dioxide, copper oxide, and aniline black. By way of example, the colorant may include a titanium oxide available under the tradename Aeroxide™ NKT 90 from Evonik Industries of Parsippany, N.J. In some embodiments, the colorant may be present between 0 parts per weight and 10 parts per weight. By way of particular example, the colorant may be present at about 1 part per weight.

The toner 300 may include a charge-control agent. When used, the charge-control agent helps maintain a desired charge within the toner to facilitate transfer of the image to the substrate from an electrostatic plate or drum. In accordance with one embodiment of the invention, the charge control agent includes negatively or positively charged control compounds that are metal-loaded or metal free complex salts, such as copper phthalocyanine pigments, zinc complex salts, aluminum complex salts, quaternary fluoroammonium salts, chromium complex salt type axo dyes, chromic complex salt, and calix arene compounds. By way of example, the charge-control agent may include a salicylic acid-zinc compound available under the tradename Bontron™ E84 from Orient Chemical Company of Chuo-ku, Osaka, Japan. In some embodiments, the charge control agent may be present between 0 parts per weight and 5 parts per weight. By way of example, the charge control agent may be present at about 1 part per weight.

The toner 300 may include a releasing agent such as a wax. The releasing agent may include one or more of low molecular weight polyolefins or derivatives thereof, such as polypropylene wax or polyethylene wax. By way of example, the releasing agent may include a polypropylene available under the tradename Viscol™ from Sanyo Chemical Industries of Higashiyama-ku, Kyoto, Japan. In some embodiments, the releasing agent may be present between 0 parts per weight and 15 parts per weight. By way of example, the releasing agent may be present at about 5 parts per weight.

The size-reduced particles 302 including the binder resin and the fluorescent pigment, along with any optional charge-control agent, colorant or releasing agent, preferably have an average particle diameter size between 6 microns (6 micrometers) and 15 microns, although particle sizes below 6 microns and above 15 microns also fall within the scope of the present disclosure.

The first inorganic material 304 can include one or more of silica or titania. For example, the first inorganic material 304 can include one or more silica available under the tradenames: Aerosil™ RY50, Aerosil™ RX50, Aerosil™ NY50 or Aerosil™ NAX50, each from Evonik Industries of Parsippany, N.J. In some embodiments, the first inorganic material 304 may be present between 0.1 parts per weight and 3 parts per weight. By way of particular example, the first inorganic material may be present at about 1 part per weight.

The second inorganic material 306 can also include one or more of a silica or a titania. For example, the second inorganic material 306 can include one or more silicas available under the tradenames: Aerosil™ R972, Aerosil™ R812, Aerosil™ 805 or Aerosil™ RY200, each from Evonik Industries of Parsippany, N.J. In some embodiments, the second inorganic material may be present between 0.1 parts per weight and 5 parts per weight. By way of particular example, the second inorganic material 306 may be present at about 3 parts per weight.

The average particle diameter size of the first inorganic material 304 is less than the average particle diameter size of the size-reduced particles 302. For example, the first inorganic material 304 can have an average particle diameter size between 20 nanometers (nm) and 50 nm or, more particularly, between 30 nm and 40 nm. By way of particular example, the first inorganic material 304 may have an average particle diameter size of 40 nm.

The average particle diameter size of the second inorganic material 306 is less than the average particle diameter size of the first inorganic material 304. For example, the second inorganic material 306 can have an average particle diameter size between 5 nm and 18 nm or, more particularly, between 7 nm and 16 nm. By way of particular example, the second inorganic material 306 can have an average particle diameter size of 16 nm The ratio of the average particle diameter size of the second inorganic material 306 to the first inorganic material 304 may be between 1 to 10 (1:10) and 9:10 or, more particularly, between 7:40 and 8:15. By way of particular example, the ratio of the average particle diameter size of the second inorganic material 306 to the first inorganic material 304 may be 4:10.

In some embodiments, one or more additional inorganic materials may be included in the toner 300. For example, a third inorganic material of silica or titania particles may provide additional benefits and/or improve benefits beyond that provided by the first inorganic material 304 and the second inorganic material 306. The one or more additional inorganic materials can have any average particle diameter size relative to the first inorganic material 304 and the second inorganic material 306.

In some embodiments, a lubricant may be added to the mixture. The lubricant can include any suitable lubricant and can clean and/or protect components of a print cartridge or system. For example, the lubricant can coat blades of the print cartridge or system in order to protect the electrostatic plate or drum from scratching. By way of example, the lubricant can include zinc stearate. In some embodiments, the lubricant may be present between 0 parts per weight and 1 part per weight. By way of particular example, the lubricant may be present at about 0.5 parts per weight.

Figure 4:
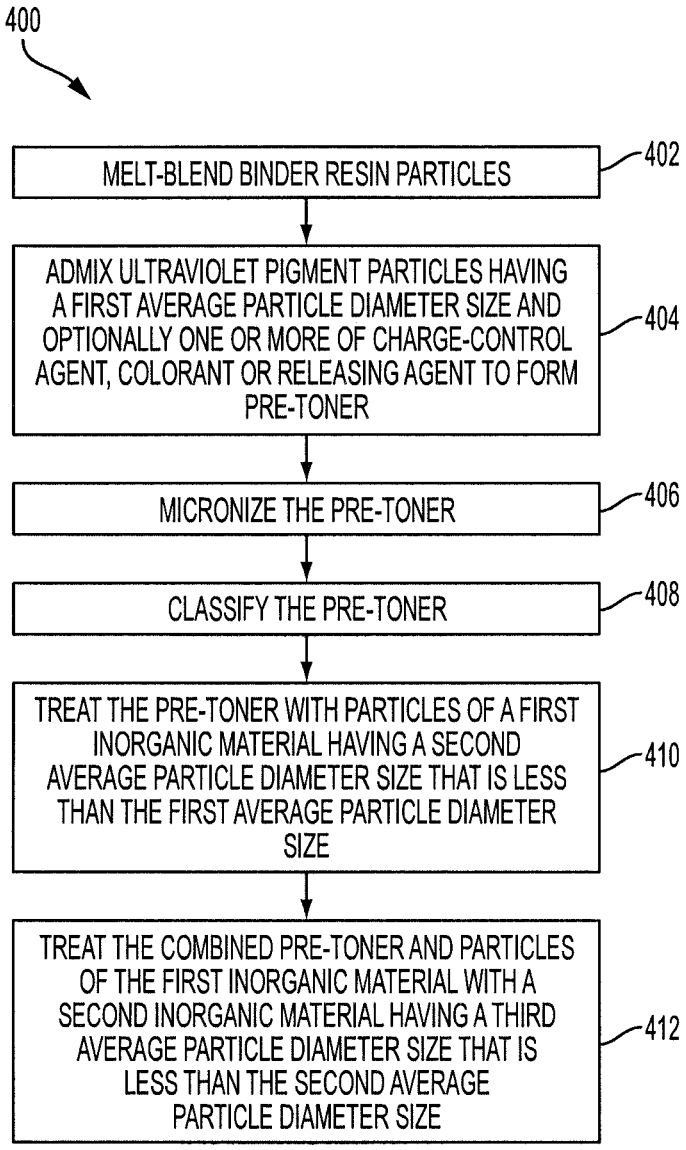
FIG. 4 is a block diagram illustrating a method for making an ultraviolet security toner such as shown in FIG. 3.

With reference now to FIG. 4, a method 400 for making a toner similar to the ultraviolet security toner 300 of FIG. 3 is shown. At 402, the binder resin particles are melt-blended. At 404, the (optional) colorant, (optional) charge controlling agent(s), (optional) release agent(s), and fluorescent pigment(s) are admixed to the binder resin particles by mechanical attrition. Where described herein, this mixture may be referred to as a pre-toner.

The pre-toner is then cooled and micronized by air attrition at 406. The micronized particles that are between about 0.1 and 20 microns in size are classified at 408 to remove fine particles, leaving a finished mixture containing particles ranging in size from 5 micron to 20 microns, or from 6 microns to 15 microns, or from 7 microns to 12 microns. The pre-toner now includes size-reduced particles similar to the size-reduced particles 302 shown in FIG. 3.

At 410, the pre-toner is treated with particles of a first inorganic material that is similar to the first inorganic material 304 of FIG. 3. For example, the pre-toner may be dry blended with finely divided particles of the first inorganic material, which may include one or more silica and/or one or more titania. This coats the surface of the size-reduced particles with the first inorganic material. The particles of the first inorganic material have an average particle diameter size that is less than the average particle diameter size of the size-reduced particles of the pre-toner.

At 412, the combination of the pre-toner and the first inorganic material is treated with a second inorganic material that is similar to the second inorganic material 306 of FIG. 3. The combined pre-toner and first inorganic material is dry blended with finely divided particles of the second inorganic material, which may include one or more silica and/or one or more titania. The second inorganic material coats the surface of the size-reduced particles already coated with the first inorganic material. The particles of the second inorganic material have an average particle diameter size that is less than the average particle diameter size of the first inorganic material.

Referring to FIG. 3, the addition of the first inorganic material 304 and then the second inorganic material 306 brings several benefits. The addition of the inorganic materials 304, 306 improves the flow of the toner particles, improves blade cleaning of the photoresponsive imaging surface of a printing machine, increases the toner blocking temperature and assists in charging of toner particles.

The inorganic materials 304, 306 coat and/or surround at least some of the size-reduced particles 302 by, for example, filling in craters of the size-reduced particles. As a result of this coating, when one of the size-reduced particles 302 moves relative to another of the size-reduced particles, the inorganic material 304, 306 reduces the friction between the moving size-reduced particles 302. This reduced friction allows the size-reduced particles 302 to move more freely, improving the flowability of the toner 300.

The inorganic materials 304, 306 improve blade cleaning in a similar manner. The inorganic materials 304, 306 coat the electrostatic plate or drum, better lubricating the plate or drum. The inorganic materials 304, 306 may collect on an outer surface of the plate or drum (e.g., may coat the outer surface of the plate or drum). As a result, the size-reduced particles 302 can be more easily removed from the plate or drum during blade cleaning.

The inorganic materials 304, 306 have a greater resistance to heat, thus increasing the blocking temperature of the toner 300.

The inorganic materials 304, 306 aid in providing and maintaining charge of the toner 300. For example, the inorganic materials 304, 306 coat and maintain the charge of the size-reduced particles 302. In some embodiments, the second inorganic material 306 will better provide and maintain the charge of the size-reduced particles 302 than the first inorganic material 304 due to the larger particle diameter size.

The use of two inorganic materials provides benefits over inclusion of only one inorganic material. For example, the addition of the first inorganic material 304 improves flow of the toner 300. The addition of the second inorganic material 306 improves the charge characteristics of the toner 300. Through experimentation, the inventors have determined that maximum benefit is achieved by first blending the first inorganic material 304 with the size-reduced particles 302 and then blending the second inorganic material 306 with the combined size-reduced particles 302 and first inorganic material 304.

Example I

The following example illustrates a preparation of an 8-micron ultraviolet security toner for the use in electrophotographic printing. This specific example used a 15 micron phosphorescent pigment from Lightleader Company. A toner containing the specific composition tabulated below (with the exception of the silicas) is initially thoroughly pre-mixed and then melt mixed in a roll mill. The resulting polymer mix is cooled and then pulverized by a Bantam pre-grinder (by Hosokawa Micron Powder System). The larger ground particles are converted to toner by air attrition and classified to a particle size with a median volume (measured on a Coulter Multisizer) of approximately 8 microns. The surface of the toner is first treated with a larger silica such as Evonik Industries Aerosil™ RY50 for one minute by dry mixing in a Henschel mixer; then blending with a smaller silica such as Evonik Industries' Aerosil™ R972 for an additional minute.

| Component | Chemical | Manufacturer | Exemplary Range (weight parts) | Specific Example (weight parts) |
|---|---|---|---|---|
| Thermoplastic Binder Resin | Polyester | Image Polymers - XPE-1976 | 20-95 | 88 |
| Charge-Controlling Agent | Salicylic Acid-Zinc compound | Orient Chemical Company-Bontron ™ E84 | 0-5 | 1 |
| Colorant | Titanium Oxide | Evonik Industries - NKT90 | 0-10 | 1 |
| Releasing Agent | Polypropylene | Sanyo Chemical Industries - Viscol ™ 330P | 0-15 | 4 |
| Flourescent Pigment | Thermoset fluorescent pigment | DayGlo Corp. - P-09 RADGLO ™ UV Blue | 1-20 | 5 |
| Lubricant | Zinc Stearate | — | 0-1 | 0.5 |
| Smaller Silica | Silica | Evonik Industries - Aerosil ™ RY50 | 0.1-3 | 1 |
| Larger Silica | Silica | Evonik Industries - Aerosil ™ R972 | 0.1-5 | 3 |

This prepared mono-component toner is loaded into the cartridge for the intended printer, such as the Hewlett Packard Color Laserjet™ CP2025 or the Hewlett Packard Laserjet™ Pro 400 color M451DN. For this example, the colorless toner was loaded into the yellow cartridge of the color printer, but this toner could be loaded in the black, cyan or magenta cartridge, if desired. An image formed using this toner exhibits a fluorescent response having sharp characters in the presence of an ultraviolet light when printed on a substrate such as a paper that is considered to be optically dead.

Although the present invention is set forth herein in the context of the appended drawing figure, it should be appreciated that the invention is not limited to the specific form shown. For example, while the invention is conveniently described in connection with electrostatic printing, the invention is not so limited; the toner of the present invention may be used in connection with other forms of printing—such as iongraphic, magnetographic, and similar imaging techniques Various other modifications, variations, and enhancements in the design and arrangement of the method and device set forth herein, may be made without departing from the spirit and scope of the present invention as set forth in the appended claims.

What is claimed is:

1. A method for preparing an ultraviolet security toner for use in printing hardware originally designed to use chemically prepared toner, the method comprising:

melt-blending binder resin particles;

forming a pre-toner by admixing an fluorescent pigment having a first average particle diameter size to the binder resin particles; and blending the pre-toner with particles of a first inorganic material having a second average particle diameter size that is less than the first average particle diameter size.

2. The method of claim 1, further comprising blending the combination of the pre-toner and the particles of the first inorganic material with particles of a second inorganic material having a third average particle diameter size that is less than the second average particle diameter size.

3. The method of claim 2, wherein the first inorganic material and the second inorganic material each include at least one of a silica or a titania.

4. The method of claim 2, wherein the first inorganic material includes at least one of Aerosil™ RY50, Aerosil™ RX50, Aerosil™ NY50 or Aerosil™ NAX50.

5. The method of claim 2, wherein the second inorganic material includes at least one of Aerosil™ R972, Aerosil™ R812, Aerosil™ R805 or Aerosil™ RY200.

6. The method of claim 2, wherein forming the pre-toner further includes admixing a charge control agent and the fluorescent pigment to the binder resin particles by mechanical attrition.

7. The method of claim 6, wherein forming the pre-toner further includes admixing a colorant and a release agent along with the charge control agent and the fluorescent pigment to the binder resin particles by mechanical attrition.

8. The method of claim 6, wherein forming the pre-toner further includes micronizing the admixed binder resin particles, fluorescent pigment and release agent by air attrition and classifying the micronized particles.

9. The method of claim 8, wherein the micronized particles are classified such that the micronized particles have an average particle diameter size between about 7 microns and about 12 microns.

10. The method of claim 2, wherein a ratio of the third average particle diameter size to the second average particle diameter size is between 1 to 10 and 9 to 10.

11. The method of claim 1, wherein the ultraviolet security toner can be used in a printer designed to use chemically prepared toner.

12. An ultraviolet security toner for use as a chemically prepared toner comprising:

fluorescent pre-toner including fluorescent pigment particles admixed to binder resin particles and having a first average particle diameter size; and a first inorganic material having a second average particle diameter size that is less than the first average particle diameter size.

13. The ultraviolet security toner of claim 12, further comprising a second inorganic material having a third average particle diameter size that is less than the second average particle diameter size.

14. The ultraviolet security toner of claim 13, wherein the first inorganic material and the second inorganic material each include at least one of a silica or a titania.

15. The ultraviolet security toner of claim 14, wherein the first inorganic material includes at least one of Aerosil™ RY50, Aerosil™ RX50, Aerosil™ NY50 or Aerosil™ NAX50 and the second inorganic material includes at least one of Aerosil™ R972, Aerosil™ R812, Aerosil™ R805 or Aerosil™ RY200.

16. The ultraviolet security toner of claim 13, wherein the binder resin particles are present between 20 parts per weight and 95 parts by weight, the fluorescent pigment particles are present between 1 part per weight and 20 parts per weight, the first inorganic material is present between 0.1 parts per weight and 3 parts per weight and the second inorganic material is present between 0.1 parts per weight and 5 parts per weight.

17. The ultraviolet security toner of claim 13, wherein the fluorescent pre-toner further includes a charge control agent, a colorant and a release agent.

18. The ultraviolet security toner of claim 13, wherein a ratio of the third average particle diameter size to the second average particle diameter size is between 1 to 10 and 9 to 10.

19. The ultraviolet security toner of claim 13, wherein the ultraviolet security toner can be used in a printer designed to use chemically prepared toners.

20. An ultraviolet security toner prepared by a method comprising:

melt-blending binder resin particles;

forming a fluorescent pre-toner by admixing an fluorescent pigment having a first average particle diameter size to the binder resin particles;

blending the fluorescent pre-toner with particles of a first silica having a second average particle diameter size that is less than the first average particle diameter size; and blending the combination of the fluorescent pre-toner and the particles of the first silica with particles of a second silica having a third average particle diameter size that is less than the second average particle diameter size.

* * * * *